US005860252A

United States Patent [19]

Öberg

[11] Patent Number: 5,860,252

[45] Date of Patent: Jan. 19, 1999

[54] ARRANGEMENT AT SELF EXPANDING BOOMS

[75] Inventor: Per Olof Öberg, Nordmaling, Sweden

[73] Assignee: Expandi Systems AB, Sweden

[21] Appl. No.: 913,018

[22] PCT Filed: Mar. 5, 1996

[86] PCT No.: PCT/SE96/00290

§ 371 Date: Sep. 4, 1997

§ 102(e) Date: Sep. 4, 1997

[87] PCT Pub. No.: WO96/27711

PCT Pub. Date: Sep. 12, 1996

[30] Foreign Application Priority Data

Mar. 6, 1995 [SE] Sweden ..... 9500803

[51] Int. Cl.[6] ..... E02B 15/06

[52] U.S. Cl. ..... 52/115; 92/52; 405/66; 405/68; 405/69

[58] Field of Search ..... 52/115; 92/52; 405/66, 68, 69, 63; 210/242.1, 923

[56] References Cited

U.S. PATENT DOCUMENTS 3,798,911 3/1974 Oberg ..... 405/69

4,573,426 3/1986 Larsson ..... 405/68

5,511,906 4/1996 Oberg ..... 405/68

FOREIGN PATENT DOCUMENTS 9102785 5/1993 Sweden .

*Primary Examiner*—Christopher Kent

*Attorney, Agent, or Firm*—Ware, Fressola, Van der Sluys & Adolphson LLP

[57] ABSTRACT

A valve mechanism for self-expanding booms. The mechanism is preferably a mechanical expansion device that folds out the boom so that air flows into the boom to fill the boom. When the boom is folded, the air is pressed out of the boom. A novel feature is an automatic control mechanism that is adapted to permit an inflow of air into the boom when the boom is expanded and to permit an outflow of air when the boom is collapsed, rolled up and stored. The control mechanism is affected by the relative position between the valve mechanism and other parts of the boom when the boom is in the expanded or collapsed position.

7 Claims, 2 Drawing Sheets

ARRANGEMENT AT SELF EXPANDING BOOMS

TECHNICAL FIELD

This invention relates to self-expanding booms and more particularly to valve mechanisms. The valve mechanisms ensure an inflow of air when the boom is expanded and an outflow of air when the boom is rolled up.

BACKGROUND INFORMATION

A plurality of air openings are defined at the upper end of the self expanding booms of the prior art. Valves are placed in the openings to permit an air inflow when the boom is expanded from a collapsed storage or transportation mode. Air disposed inside the boom is also permitted to flow out through the openings when the boom is taken up, collapsed and rolled up on transportation or storage rolls or a similar devices.

While employing the boom, that is when the boom is floating in the water, the air openings must be closed to prevent water from flowing into the boom and to prevent air from undesirably flowing out of the boom sections so that the sections sink.

In an embodiment of the prior art, a plurality of tube protrusion or similar devices are placed along the upper edges of the boom. The protrusions are equipped with an outward shiftable or rotatable locking mechanism. In one position, the locking mechanism permits an uninhibited inflow and outflow of air and in a different position the protrusion is closed.

This type of air openings require manual adjustments both when the boom is laid down and when the boom is taken up and rolled up.

One object of the present invention is to provide a new device that, without the need for manual adjustments, permits uninhibited inflow of air when the boom is expanded and prevents water from flowing in when the boom is in use. Additionally, the air inside the boom must be permitted to freely flow out of the boom when the boom is taken up and collapsed.

SUMMARY OF THE INVENTION

An object of the present invention is to take advantage of the inherent changes of the position of the various parts or details to shift the valve body into and out of a closed position when the boom is expanded and collapsed, respectively.

In the preferred embodiment of the present invention, this object is achieved by attaching one end of a bendable member to the valve body. The other end of the bendable member is attached to an expansion mechanism disposed inside the boom or to another part disposed inside the boom. The part is shiftable relative to the valve mechanism when the boom is expanded and collapsed. In this way, when the boom is collapsed, the bendable member, which may be a cord, is extended to shift the valve body from its sealing and air outflow inhibiting position so that the boom may effectively be emptied of air. However, when the boom is laid out and the expansion devices are permitted to expand, the pulling movement of the cord stops and the valve mechanism returns to its rest position so that air may flow into the boom.

BRIEF DESCRIPTION OF THE DRAWINGS

A preferred embodiment of the present invention is described below with the reference to the following enclosed drawings wherein.

DETAILED DESCRIPTION

Figure 1:
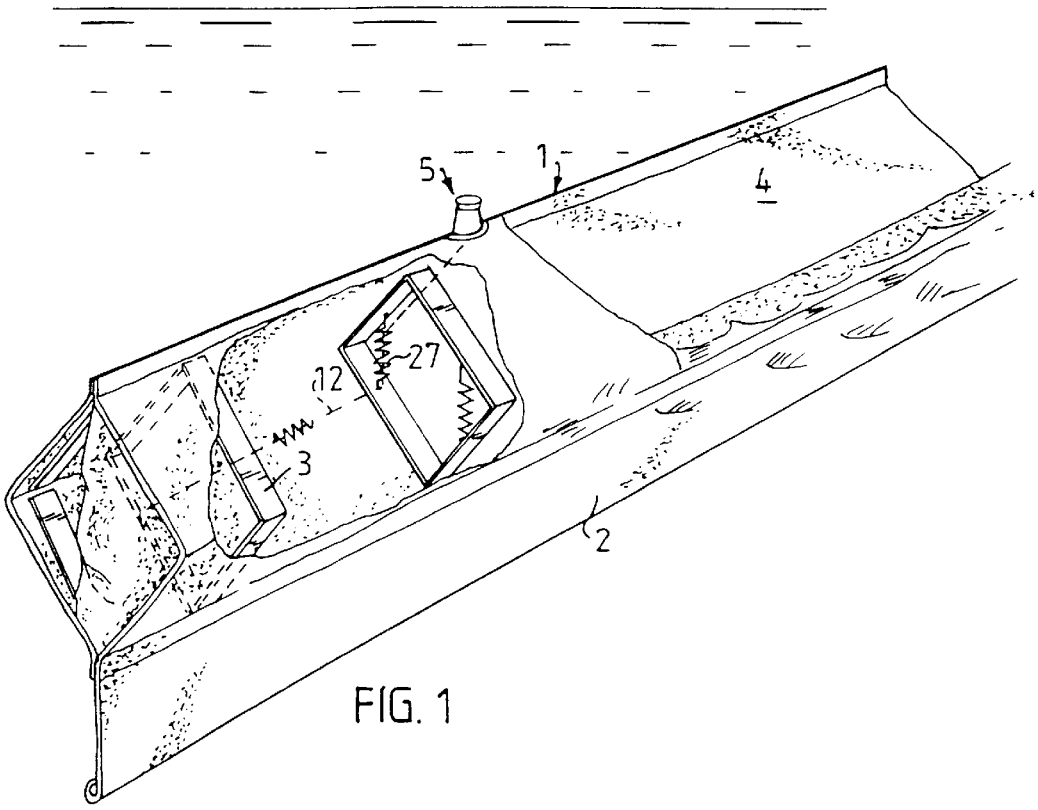
FIG. 1 is a perspective view and a partly opened section view of a boom according to the preferred embodiment of the present invention.

With reference to the figures, a boom of the present invention has a main portion 1 and a so called skirt 2 protruding downwardly. The boom consists of a bendable impervious material such as a woven textile reinforced plastic material. A number of spring biased expansion devices 3 are disposed within the boom. The expansion devices 3 have the function of separating walls 4 so that air may be sucked into the boom when the boom is expanded from an almost flat collapsed position after the boom has been removed from a transport and storage reel. When, on the other hand, the boom is collapsed after use, the expansion devices 3 are collapsed against the biasing forces of the springs so that the walls 4 are moved together and the air captured inside the boom is removed. The collapsed position is normally achieved by winding the boom on to a storage reel. Both the air inflow and the air outflow are conducted through a valve mechanism 5. The valve mechanisms is usually bonded to a pipe shaped support stud 6 that is welded or bonded to the plastic material at the upper portion of the boom where the upwardly sloping walls 4 are joined to one another.

According to the present invention, the valve mechanism 5 functions automatically without any manual intervention so that air is permitted to flow into the boom when the boom is expanded and out of the boom when the boom is collapsed and otherwise prevents water, essentially also air from passing through.

Figures 3, 4:
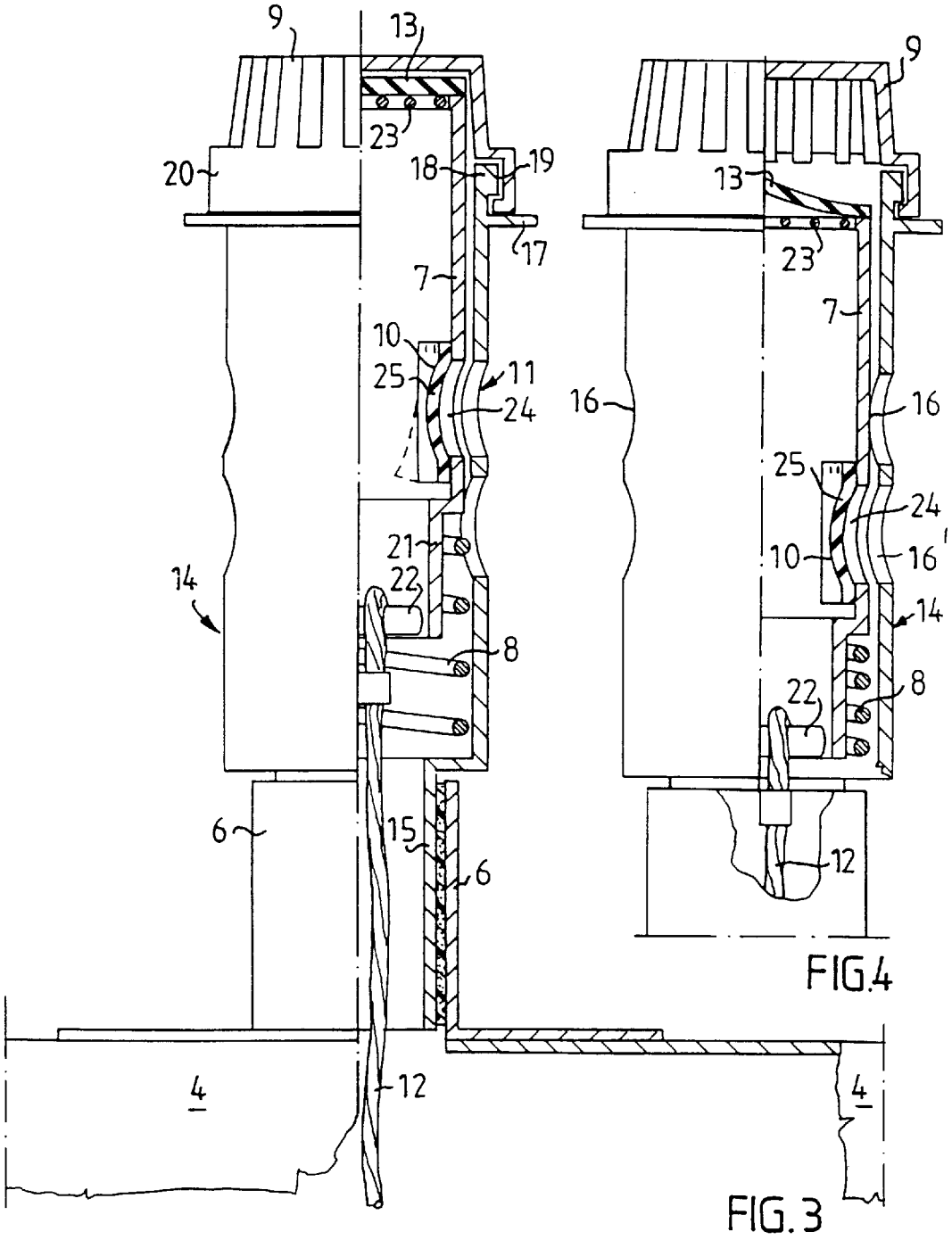
FIG. 3 is an enlarged side view in partial cross-section of the valve mechanism attached to the upper portion of the boom wherein the valve mechanism is in a first position.
FIG. 4 is a side view in partial cross-section of a portion of the view of FIG. 3 wherein the valve body is in a second position.

The automatic valve mechanism 5 includes a valve body 7 and a biasing spring 8 cooperating therewith so that the valve body 7 is shiftable between a first position defined by the spring 8 and a perforated lid 9 forming an abutment, FIG. 3, so that air is permitted to be sucked in through one or a plurality of passages 11 provided with check valve means 10, and a second position, FIG. 4, into which the valve member 5 is shifted by the influence of tension of a flexible member in the form of a cord 12 against the biasing force of the spring 8, in which air is allowed to flow out through the perforated lid 9 by another check valve means.

Below is a more detailed description of the valve mechanisms 5. The valve mechanisms 5 includes a valve housing 14 having a narrow portion 15 at a lower end thereof. The narrow portion is adapted to be inserted into and glued to the support stud 6. Two or more radially disposed openings 16 are defined in the housing 14. Each opening form a part of the passage 11. A free end of the housing 14 has an outward flange 17 having an outward protrusion 18 in operative engagement therewith. An axially protruding portion 20 of the lid 9 has an inward groove 19 defined therein that is adapted to engage the protrusion 18. The lid 9 is presumably made of a plastic material or a similar material that has a certain elasticity.

The valve body 7 is shaped like a casing and has a narrow portion 21 disposed at one end thereof so that a space is defined between the portion 21 and the inside of the valve housing 14 to receive the spring 8. The narrow end of the casing is open and includes a fastening mechanism 22 to hold a bendable member such as the cord 12. The opposite end of the casing is perforated or has a grate shaped end wall enclosure 23. One end of a tongue shaped check valve member 13 is attached to an edge portion of the end enclosure 23 so that the valve member 13 will be able to function as a check valve. It is important that the tongue, which is made of a suitable rubber material or a similar material is light so that it may be bent by a weak air flow. For this reason, the material is porous.

In the casing of the valve body 7 are two or possibly more than two radially facing openings 24 defined. Only one opening is shown. The check valve mechanism 10 is attached to the inside of the casing adjacent the openings 24. Similarily with the check valve 13 at the end of the valve housing 14, the check valve mechanism 10 includes a movable tongue 25 that is made of a soft flexible material and is bendable by an air stream. Attached around each opening 24 is an elastic seal (not shown). This seal may be an O-ring or have a similar shape, and be pressed, in a suitable way, into a groove to form around the opening 24 a seal sealingly engaging the inside of the valve housing 14.

FIG. 3 shows the valve 5 in a rest position which means that the cord 12 is slack and the spring 8 is urging the valve body 7 upwardly so that the back valve member 13 at the perforated upper end is held against the inside of the lid 9. In this way, the upper opening is mechanically closed for air flow in both directions. If, when the valve is in this position, a pressure lower than the atmospheric is created inside the boom, which occurs when the boom is expanded, air is sucked in through the passages 11 that is through the openings 16 and 24 by the check valve mechanism or tongue 25 to fill the boom. The air can not flow back out because the tongues of the back valve mechanism close the passages.

The cord 12 extends from the valve mechanism through springs 27 disposed at two of the expansion devices 3—in some cases, one spring is sufficient—and one end of the cord is attached to the wall of the boom. When the boom is folded together or collapsed, the springs 27 of the expansion devices are stretched. As a result of the lengthening of the springs 27 when the boom is collapsed, the cord 12 is put under tension because one end of the cord is secured to the boom and the other end of the cord 12 is attached to the valve body 7. As a consequence, the cord 12 pulls the valve body 7 downwardly against the biasing force of the spring 8. Because the valve body 7 is shifted downwardly, the upper end of the valve body 7 is removed from the lid 9 so that the tongue 13 is bent outwardly as air flows out as a result of the high pressure created inside boom by the collapse of the boom.

In the preferred embodiment of the present invention, the valve housing 14 has two pair of radially disposed openings 16 and 16' defined therein. The openings are positioned at different levels. The reason for this is that when an expansion operation is started, air must be able to enter into the boom to permit proper expansion of the boom. In the beginning stage when the valve body is in the position as shown in FIG. 4, air may be sucked in through openings 16'. However, due to the contraction of the springs 27, the tensioning of the cord 12 stops and when the valve body 7 reaches the position shown in FIG. 3 air flows into the openings 16.

Figure 2:
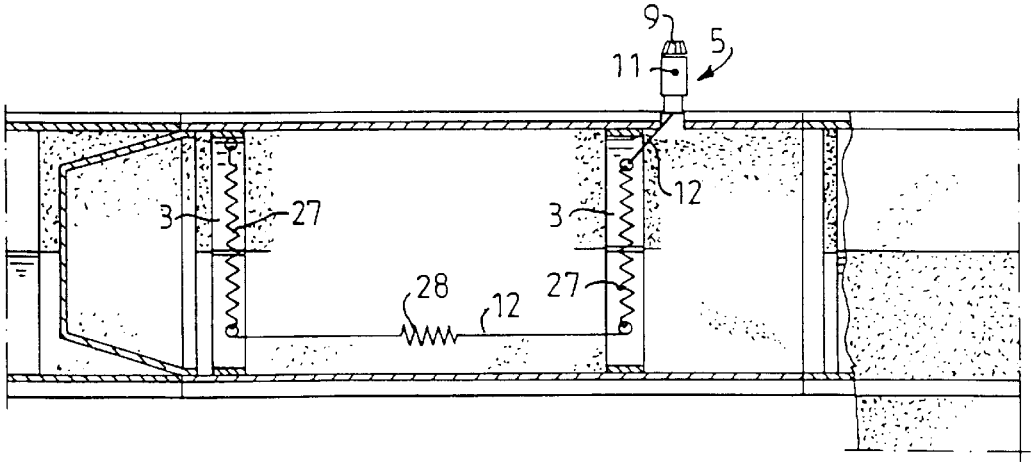
FIG. 2 is a side view in partial cross-section of the invention shown in along line 1—1 of FIG. 1.

To make it easier to adjust the length of the cord 12 and to eliminate the risk of tearing off the cord 12 or that the valve mechanism 5 is damaged by an unexpectedly powerful tensioning of the cord 12, it is desirable, as indicated in FIG. 2, to provide the cord 12 with an elastic mid portion 28. The mid portion may be a spring or a similar device that is positioned at a suitable part of the cord.

While the present invention has been described with reference to preferred embodiments, it is to be understood that certain substitutions and alterations may be made thereto without departing from the spirit and scope of the invention as set forth in the appended claims.

What is claimed is:

1. A device providing ventilation of a self expanding boom that ensures an air inflow into the boom arranged as a substantially sealed container when the boom is expanded and that ensures an air outflow when the boom is collapsed, the device comprising an automatic valve means having a valve body which, as a result of relative movement between portions of the boom, is shiftable between a first position in which the valve body permits air inflow into the boom and a second position in which the valve body permits air outflow from the boom; and further including a flexible member connected between the boom and the valve body in such a way that the flexible member is substantially slack when the boom is expanded and the valve body is in its first position whereas, when the boom is collapsed, the flexible member is tightened and displaces the valve body to its second position to permit air outflow from the boom.

2. The device according to claim 1, wherein the automatic valve means in the second position of the valve body is arranged to permit air outflow from the boom only as long as there is a pressure above atmospheric pressure inside the boom, whereas the automatic valve means in the first position of the valve body is arranged to permit air inflow to the boom in the presence of partial vacuum caused by expansion of the boom.

3. The device according to claim 1, wherein the flexible member includes an elastic intermediary portion to absorb tension forces beyond those absorbed by the valve body.

4. The device according to claim 1, wherein the automatic valve means further includes an essentially substantially tube shaped housing, the valve body being essentially tube shaped and axially movable inside the housing, the valve body and the housing have cooperating openings permitting the air inflow when the boom is expanded and cooperating openings permitting air outflow when the boom is collapsed, at least some of the cooperating openings have check valve means permitting flow of air only in one direction.

5. The device according to claim 4, wherein each check valve means includes a tongue made of an elastic material, an edge portion of each tongue being attached to the valve body.

6. The device according to claim 4, further including a sealing device encompassing each cooperating opening in the valve body to sealingly engage with an inside wall of the valve housing.

7. The device according to claim 4, wherein each cooperating inflow opening in the valve body cooperates with one respective cooperating inflow opening in the valve housing when the valve body is in its first position and cooperates with another respective cooperating inflow opening in the valve housing when the valve body is in its second position.

* * * * *

UNITED STATES PATENT AND TRADEMARK OFFICE

CERTIFICATE OF CORRECTION

PATENT NO. : 5,860,252

DATED : January 19, 1999

INVENTOR(S) : Per Olof Öberg

It is certified that error appears in the above-identified patent and that said Letters Patent is hereby corrected as shown below:

In column 2, line 31, "mechanisms" should be --mechanism 5--.

In column 2, lines 53-54, both instances of "mechanisms" should be --mechanism--.

Signed and Sealed this

First Day of June, 1999

*Attest:*

Q. TODD DICKINSON

*Attesting Officer*

*Acting Commissioner of Patents and Trademarks*